US011614240B2

(12) United States Patent
Yamaguchi et al.

(10) Patent No.: US 11,614,240 B2
(45) Date of Patent: Mar. 28, 2023

(54) CEILING CONCEALED AIR-CONDITIONING APPARATUS

(71) Applicant: Mitsubishi Electric Corporation, Tokyo (JP)

(72) Inventors: Koji Yamaguchi, Tokyo (JP); Tetsuya Tazawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 328 days.

(21) Appl. No.: 16/623,901

(22) PCT Filed: Aug. 21, 2017

(86) PCT No.: PCT/JP2017/029738
§ 371 (c)(1),
(2) Date: Dec. 18, 2019

(87) PCT Pub. No.: WO2019/038798
PCT Pub. Date: Feb. 28, 2019

(65) Prior Publication Data

US 2021/0003291 A1 Jan. 7, 2021

(51) Int. Cl.
*F24F 1/0047* (2019.01)
*F24F 13/08* (2006.01)
(Continued)

(52) U.S. Cl.
CPC ..... *F24F 1/0047* (2019.02); *F24F 13/084* (2013.01); *F24F 13/20* (2013.01); *F24F 13/30* (2013.01); *F24F 2013/205* (2013.01)

(58) Field of Classification Search
CPC ..... F24F 13/082; F24F 13/084; F24F 13/20; F24F 13/30; F24F 2221/14; F16B 5/0266;
(Continued)

(56) References Cited

U.S. PATENT DOCUMENTS 3,724,889 A * 4/1973 Dooley ..... E05C 1/10 292/87
3,907,347 A * 9/1975 Hollis ..... E05C 1/08 292/169.13
(Continued)

FOREIGN PATENT DOCUMENTS

EP 3550218 A1 10/2019
JP 04244529 A * 9/1992
(Continued)

OTHER PUBLICATIONS

Extended European Search Report dated Jul. 22, 2020 issued in corresponding European patent application No. 17922383.9.
(Continued)

*Primary Examiner* — Jianying C Atkisson
*Assistant Examiner* — For K Ling
(74) *Attorney, Agent, or Firm* — Posz Law Group, PLC

(57) ABSTRACT

The ceiling concealed air-conditioning apparatus includes: a body containing a heat exchanger, a fan and an opening port; a decorative panel disposed below the body and configured to cover a periphery of the opening port; and a suction grille including, a rotary shaft attachable to the decorative panel and being configured to cover the opening port, wherein the suction grille includes: a locking element mounted on the suction grille so that it can slide and configured to be locked with the decorative panel; plate springs on respective sides of the locking element perpendicular to a sliding direction of the locking element and extending vertically in opposite directions; and spring supports configured to support both end faces of the respective plate springs at different positions, the plate springs include a long plate spring and a short plate spring placed such that the long plate spring engages the decorative panel first.

9 Claims, 9 Drawing Sheets

(51) Int. Cl.
*F24F 13/20* (2006.01)
*F24F 13/30* (2006.01)

(58) Field of Classification Search
CPC .... F16B 5/0016; F16B 5/0664; F16B 5/0614; E05C 1/10; E05C 1/085; E05C 1/08; E05C 1/16
See application file for complete search history.

(56) References Cited

U.S. PATENT DOCUMENTS 5,496,078 A * 3/1996 Yasuda ..... E05C 1/08 292/DIG. 31
6,327,151 B1 * 12/2001 Chen ..... G06F 1/1616 292/164
8,014,135 B2 * 9/2011 Yu ..... E05B 65/006 292/164

FOREIGN PATENT DOCUMENTS

JP 2003122056 A * 4/2003 ..... B60K 37/02
JP 2003262353 A * 9/2003
JP 2009-299999 A 12/2009
JP 2009287899 A * 12/2009
JP 2009299999 A * 12/2009

OTHER PUBLICATIONS

International Search Report of the International Searching Authority dated Nov. 7, 2017 for the corresponding international application No. PCT/JP2017/029738 (and English translation).

* cited by examiner

CEILING CONCEALED AIR-CONDITIONING APPARATUS

CROSS REFERENCE TO RELATED APPLICATION

This application is a U.S. national stage application of PCT/JP2017/029738 filed on Aug. 21, 2017, the contents of which are incorporated herein by reference.

TECHNICAL FIELD

The present invention relates to a ceiling concealed air-conditioning apparatus attached to a ceiling, and more particularly to a decorative panel that opens and closes a suction grille from a bottom side.

BACKGROUND ART

A known conventional ceiling concealed air-conditioning apparatus includes a suction grille attached to a decorative panel so that it can be opened and detached. To avoid deterioration in design of the decorative panel, typically, a slide part is provided at an end of the suction grille and the slide part is manually moved to allow the suction grille to be engaged with the decorative panel. Another known example of the ceiling concealed air-conditioning apparatus incorporates a spring mechanism into a slide mechanism to save labor in opening and closing or detaching and attaching the suction grille and also integrates a locking element and a plate spring to reduce the number of components (e.g., see Patent Literature 1).

CITATION LIST

Patent Literature

Patent Literature 1: Japanese Unexamined Patent Application Publication No. 2009-299999

SUMMARY OF INVENTION

Technical Problem

The decorative panel is typically made of resin. Accordingly, the component integrating a slide part and a spring part is also typically made of resin. Use of such resin components may cause backlash between the components during assembly of the decorative panel due to variations in molded resin components, which are in turn due to variations in factors such as thermal stress and liquidity during molding. Also, there is a concern for durability as a stress is applied on a spring fulcrum when the spring function takes place.

The present invention has been made in view of the above problems and aims to provide a ceiling concealed air-conditioning apparatus that can reduce backlash during assembly due to molding variations, reduce deterioration in operability due to such backlash, and improve durability by increasing the number of fulcrums for exertion of the spring function and thereby dispersing stress on the fulcrums.

Solution to Problem

According to an embodiment of the present invention, there is provided a ceiling concealed air-conditioning apparatus including: a body containing a heat exchanger and a fan and including an opening port at the bottom; a decorative panel disposed below the body, the decorative panel being configured to cover a periphery of the opening port of the body; and a suction grille including, on one edge thereof, a rotary shaft that can be attached to the decorative panel, the suction grille being configured to cover the opening port of the body so as to allow the opening port to be opened, wherein the suction grille includes: a locking element mounted on the suction grille so that it can slide and configured to be locked with the decorative panel; plate springs on respective sides of the locking element perpendicular to a sliding direction of the locking element, the plate springs extending vertically in opposite directions to each other; and spring supports provided to the suction grille and configured to support both end faces of the respective plate springs at different positions, the plate springs of the locking element include a long plate spring and a short plate spring having different lengths, and the long plate spring and the short plate spring are placed such that the long plate spring is engaged with the decorative panel first.

Advantageous Effects of Invention

The ceiling concealed air-conditioning apparatus of an embodiment of the present invention includes: a body containing a heat exchanger and a fan and including an opening port at the bottom; a decorative panel disposed below the body, the decorative panel being configured to cover a periphery of the opening port of the body; and a suction grille including, on one edge thereof, a rotary shaft that can be attached to the decorative panel, the suction grille being configured to cover the opening port of the body so as to allow the opening port to be opened, wherein the suction grille includes: a locking element mounted on the suction grille and configured to be locked with the decorative panel; plate springs on respective sides of the locking element perpendicular to a sliding direction of the locking element, the plate springs extending vertically in opposite directions to each other; and spring supports provided to the suction grille and configured to support both end faces of the respective plate springs at different positions, the plate springs of the locking element include a long plate spring and a short plate spring having different lengths, and the long plate spring and the short plate spring are placed such that the long plate spring engages the decorative panel first. Accordingly, even when the locking element is placed in a direction vertical to the rotary shaft of the suction grille for attachment to the decorative panel, backlash is less likely to occur and smooth engagement is enabled, thereby improving operability.

DESCRIPTION OF EMBODIMENTS

Figure 1:
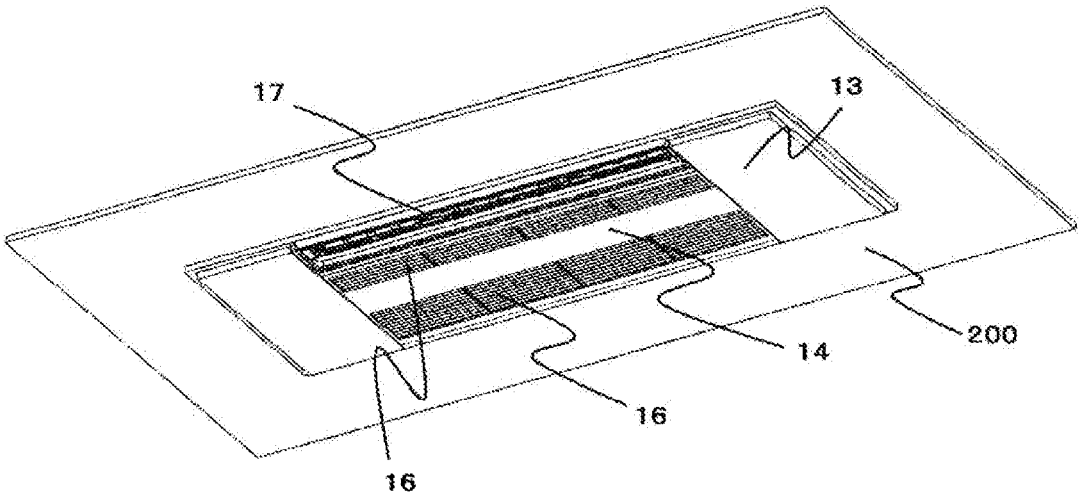
FIG. 1 is a perspective view of a ceiling concealed air-conditioning apparatus according to Embodiment 1 of the present invention when it is installed in a ceiling surface and viewed from below.
Figure 2:
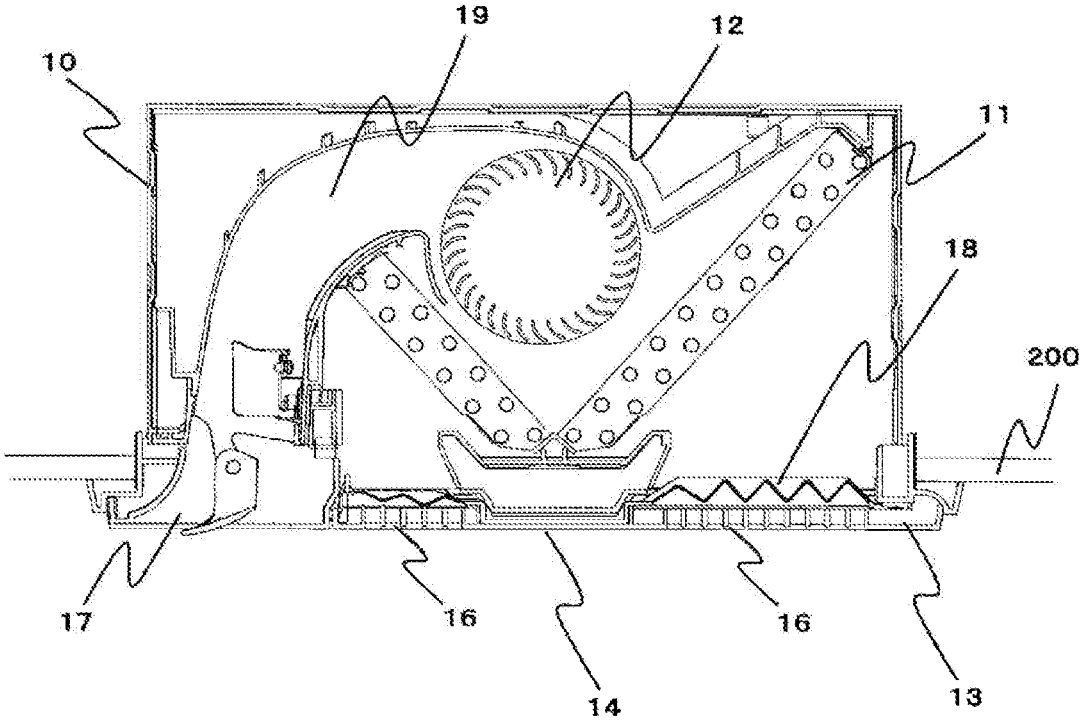
FIG. 2 is a sectional view of the inside of the ceiling concealed air-conditioning apparatus according to Embodiment 1 of the present invention.
Figure 3:
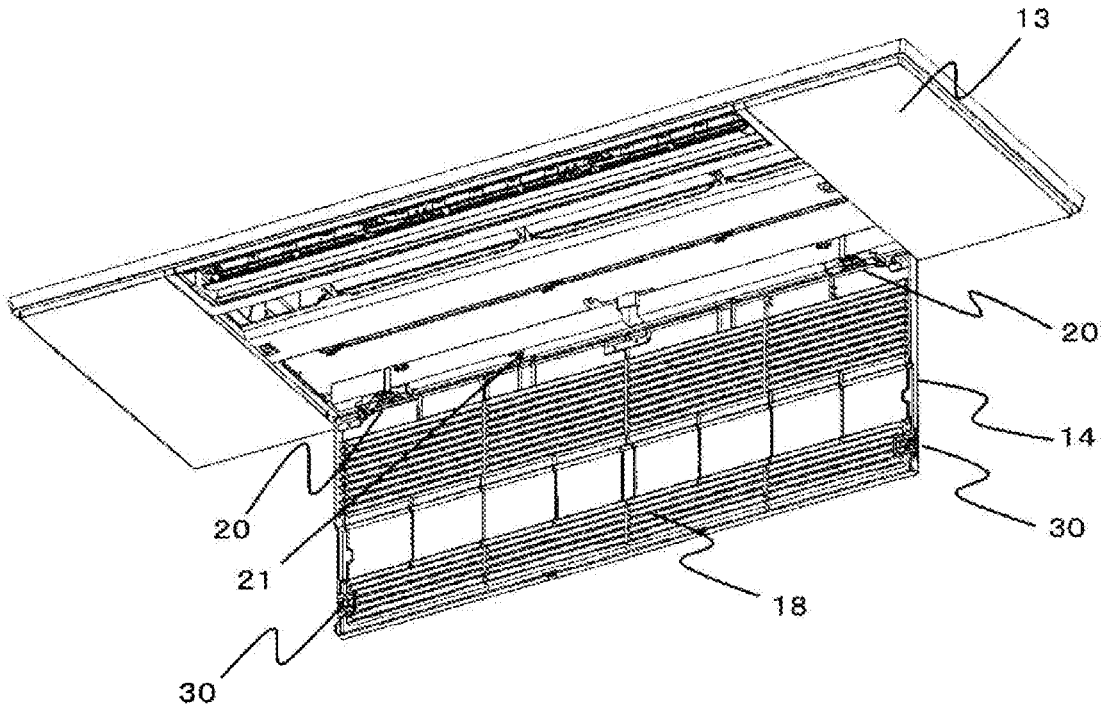
FIG. 3 is a perspective view of the ceiling concealed air-conditioning apparatus according to Embodiment 1 of the present invention when its suction grille is opened.

FIG. 1 is a perspective view of a ceiling concealed air-conditioning apparatus according to an embodiment of the present invention when it is installed in a ceiling surface and viewed from below. FIG. 2 is a schematic sectional view of the inside of the body shown in FIG. 1. FIG. 3 is a perspective view of the suction grille shown in FIG. 1 when it is opened.

As shown in FIGS. 1 to 3, the body 10 of the ceiling concealed air-conditioning apparatus contains a heat exchanger 11 and a fan 12 and includes a decorative panel 13 covering a periphery of an opening port at the bottom and a suction grille 14 covering the opening port of the body 10 defined by the decorative panel 13 such that the opening port can be opened. The decorative panel 13 and the suction grille 14 of the ceiling concealed air-conditioning apparatus are exposed from a ceiling plate 200, and the body 10 is installed inside the ceiling plate 200. The body 10 of the ceiling concealed air-conditioning apparatus is connected to an outdoor unit (not shown) with refrigerant pipes.

The heat exchanger 11 of the body 10 of the ceiling concealed air-conditioning apparatus exchanges heat between air, which is to be air-conditioned, and refrigerant. The heat exchanger 11 is an indoor heat exchanger forming a part of a refrigerant circuit comprised of a compressor, a four-way valve, an outdoor heat exchanger, an expansion valve, and the indoor heat exchanger successively connected to each other by pipes. The heat exchanger 11 serves as a condenser during a heating operation to condense and liquefy the refrigerant, and serves as an evaporator during a cooling operation to evaporate and gasify the refrigerant.

The body 10 is formed of a cuboid metal plate with an opening port at the bottom. The suction grille 14 has a rectangular shape along a longitudinal direction of the body 10. The suction grille 14 includes, at its respective ends in a transverse direction, air inlets 16 each composed of multiple grilles and formed lengthwise. The suction grille 14 is formed by resin molding. The decorative panel 13 is fixed to the body 10. The decorative panel 13 is formed with an air outlet 17 on one side of the air inlets 16. A pivotable wind vane for changing air blow directions is attached to the air outlet 17.

The suction grille 14 is, at its edge on one of the air inlets 16, supported by a rotary shaft 20 attached to the body 10 so as to be able to rotate. The suction grille 14 is capable of opening and closing the opening port of the body 10 by rotating about the rotary shaft 20. A pair of locking elements 30 are attached to respective edges of the suction grille 14 extending at right angles from the edge of the suction grille 14 supported by the rotary shaft 20. The locking elements 30 hold the suction grille 14 closed when the opening port of the body 10 is closed by the suction grille 14.

The suction grille 14 is configured to open and close to enable replacement of an air filter 18 (described later) and cleaning inside the body 10. The air filter 18 is attached so that it can be removed, to a side of each air inlet 16 facing the inside of the body 10, which is the rear side of the air inlet 16. The air filter 18 collects dust contained in air entering the body 10 through each air inlet 16.

The fan 12 includes, for example, a cross-flow fan placed on a wind path 19 communicating with the air outlet 17, and a motor (not shown) placed on one side of the cross-flow fan in the axial direction thereof. The heat exchanger 11 is placed in a V-shape between the fan 12 and the air inlets 16.

In the above configured ceiling concealed air-conditioning apparatus, driving the fan 12 causes indoor air to be suctioned from the air inlets 16 of the suction grille 14 and enter the body 10 through the air filter 18. The air having entered the body 10 is further suctioned by the fan 12 toward the heat exchanger 11, where the air exchanges heat with refrigerant flowing in the heat exchanger 11. The air having undergone the heat exchange is sent to the wind path 19 and then blown into the room from the air outlet 17.

With reference to FIGS. 4 to 7, a description will be given on the structure of the above locking element 30.

Figure 4:
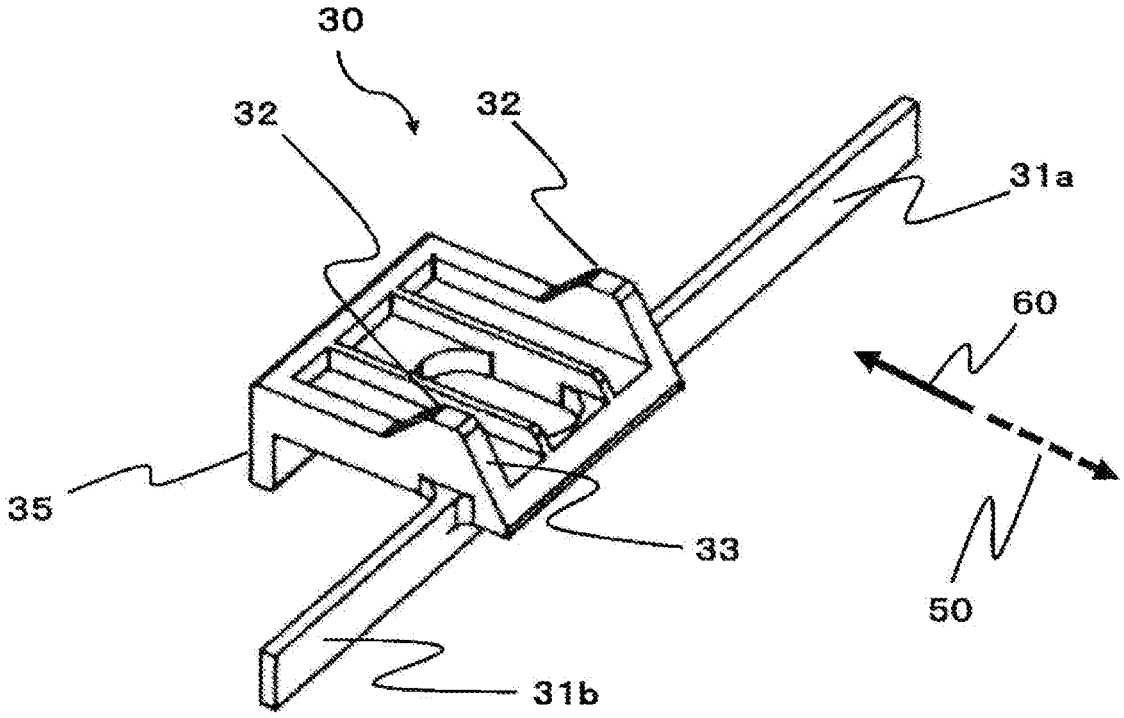
FIG. 4 is an enlarged view of a locking element provided to the suction grille of the ceiling concealed air-conditioning apparatus according to Embodiment 1 of the present invention.
Figure 5:
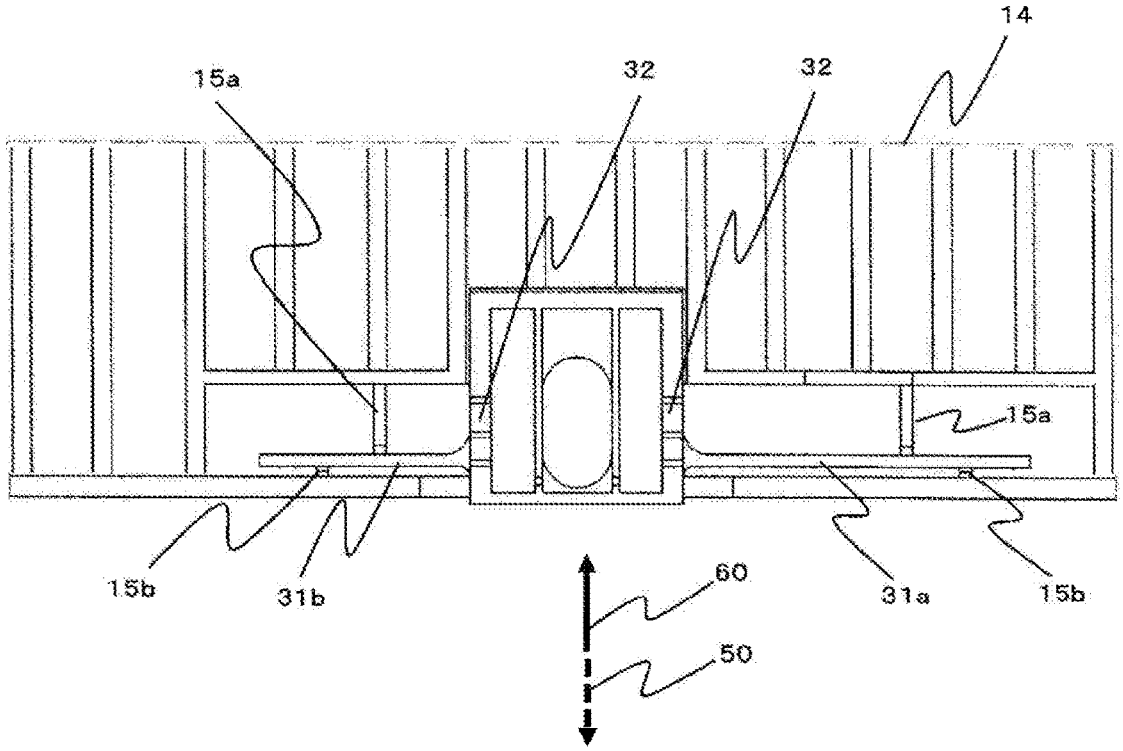
FIG. 5 is a plan view of the locking element when it is mounted on the suction grille of the ceiling concealed air-conditioning apparatus according to Embodiment 1 of the present invention.
Figure 6:
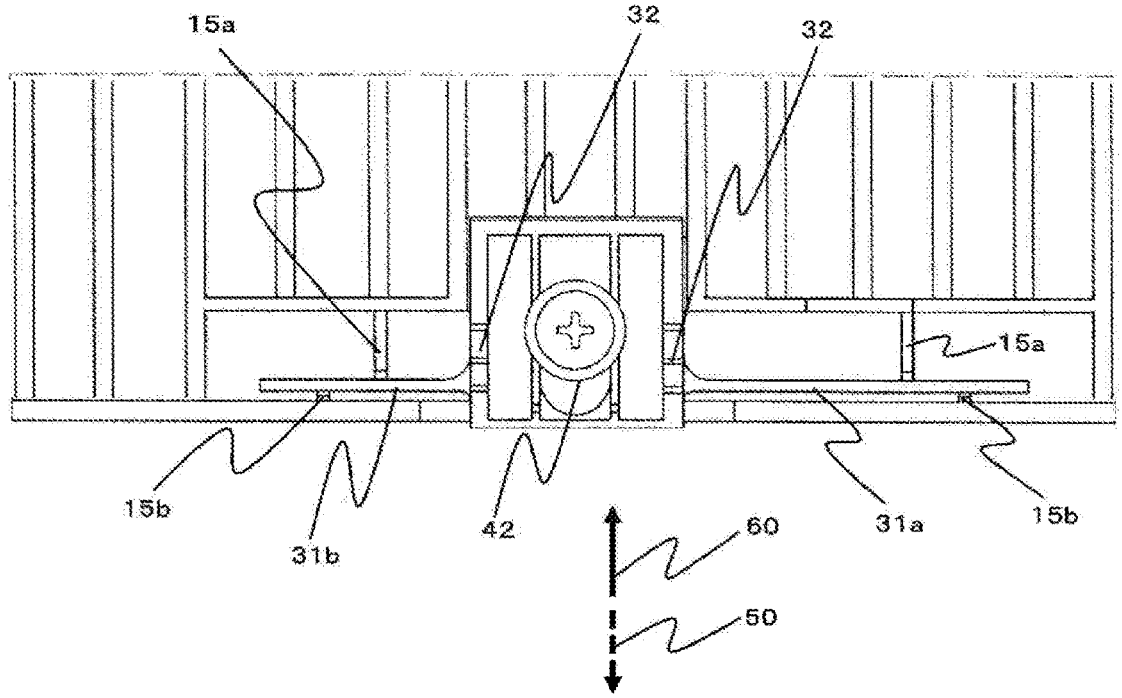
FIG. 6 is a plan view of the locking element when it is supported so as to be able to slide by the suction grille of the ceiling concealed air-conditioning apparatus according to Embodiment 1 of the present invention.
Figure 7:
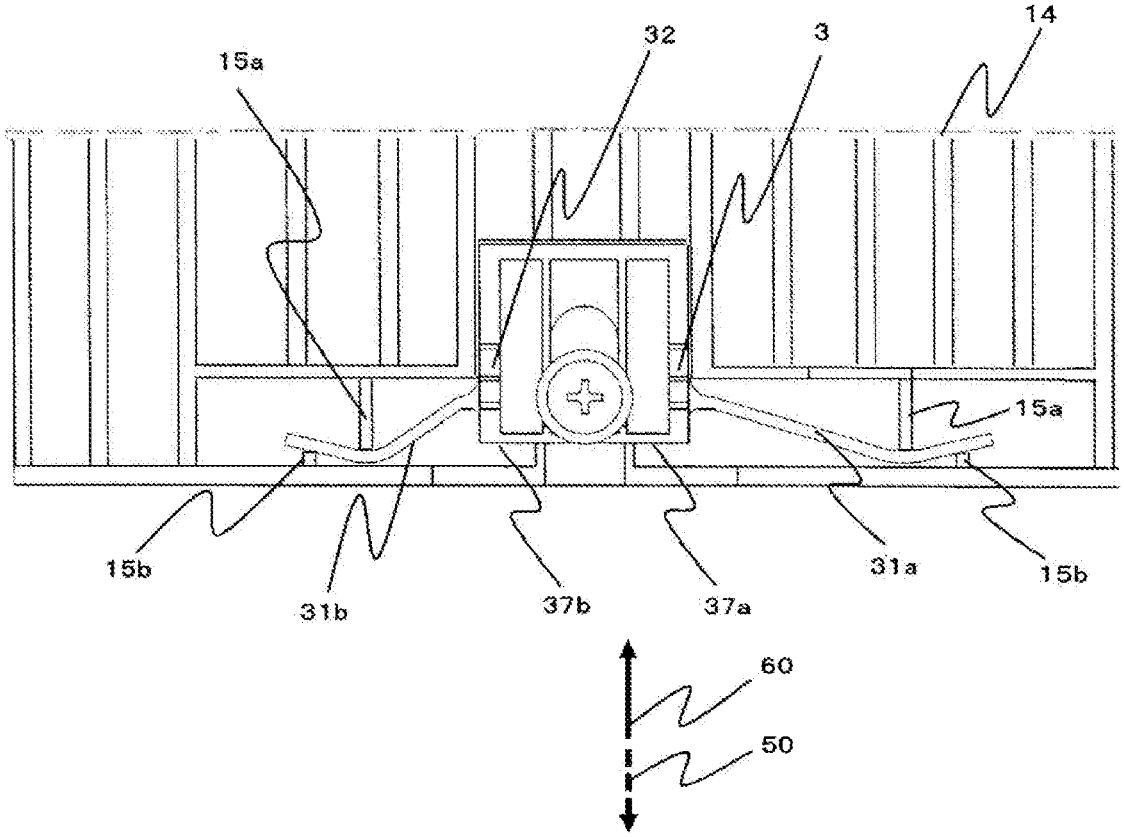
FIG. 7 is a plan view of the locking element when it is retracted into the suction grille of the ceiling concealed air-conditioning apparatus according to Embodiment 1 of the present invention.

FIG. 4 is an enlarged view of one of the locking elements shown in FIG. 3. FIG. 5 is a plan view showing the locking element of FIG. 4 when it is mounted on the suction grille. FIG. 6 is a plan view showing the locking element of FIG. 5 when it is supported by the suction grille so as to be able to slide. FIG. 7 is a plan view showing the locking element of FIG. 6 when it is retracted.

As shown in FIG. 4, a long plate spring 31*a* and a short plate spring 31*b* each formed in a plate shape by resin molding are attached to the locking element 30. The long plate spring 31*a* and the short plate spring 31*b* extend at right angles in an advancing and retracting direction and are opposite to each other. The locking element 30 includes a locking part 32, a guide part 33, an operation part 35, a pair of slide parts in between the guide part 33, and a long hole defined by the pair of slide parts.

The locking part 32 is a protrusion protruding upward further than a distal end of the guide part 33 of the locking element 30. The guide part 33 protrudes upward from the top face at each end of the locking element 30. The guide part 33 has an inclined surface. The long plate spring 31*a* and the short plate spring 31*b* extend opposite to each other and at right angles from respective ends of the locking element 30 perpendicular to its sliding direction. The operation part 35 extends downward from a rear part of the locking element 30. The slide parts receive a screw 40. The long hole extends lengthwise in the front-back direction of the locking element 30 and allows for insertion of the screw 40.

As shown in FIG. 5, the locking element 30 resides on the air inlet 15 side of the suction grille 14 and rests on a support frame extending to the inside of the air inlet 15 from the grille located at the end of the air inlet 15. The support frame is formed with a screw hole to receive the above-described screw 40 and supports the locking element 30 so that the locking element 30 can slide in the longitudinal direction of the long hole.

Each of the long plate spring 31*a* and the short plate spring 31*b* extending from the respective sides of the locking element 30 is sandwiched between a main rib 15*a* and an auxiliary rib 15*b* provided on two respective grilles on the end side of the plural grilles forming the air inlet 16. Each of the long plate spring 31*a* and the short plate spring 31*b* is held at two points by these ribs 15*a*, 15*b*. This can correct any deformation or variation of the long and short plate springs 31*a*, 31*b* in an advancing direction 50 or a retracting direction 60 that may occur during molding of the long and short plate springs 31*a*, 31*b*. The main rib 15*a* and the auxiliary rib 15*b* are spring supports integrally molded with the suction grille 14 and hold both sides of each of the long plate spring 31*a* and the short plate spring 31*b* at different positions. The main rib 15*a* and the auxiliary rib 15*b* are positioned such that those holding the long plate spring 31*a* are farther from the locking part 32 than those holding the short plate spring 31*b* are.

When the locking element 30 of FIG. 6 is moved in a direction (retracting direction) indicated by the solid arrow shown in FIG. 7 by manual operation of the operation part 35, each of the long and short plate springs 31*a*, 31*b* bends in the retracting direction 60 around the main rib 15*a* and the auxiliary rib 15*b* as fulcrums against the elastic force. Upon release of the hand from the operation part 35, the locking element 30 is energized by the elastic force of the long and short plate springs 31*a*, 31*b* in a direction (advancing direction 50) indicated by the dashed arrow, returning to the state shown in FIG. 6.

When the locking element 30 shown in FIG. 7 moves in the retracting direction 60, the long and short plate springs 31*a*, 31*b* extending at right angles bend and thereby generate spring reaction force in the advancing direction 50 around the main rib 15*a* and the auxiliary rib 15*b* as fulcrums. Using the main rib 15*a* and the auxiliary rib 15*b* as fulcrums can disperse reaction force on the fulcrum parts generated by the spring reaction force.

The spring reaction force generated in the advancing direction 50 can be adjusted by changing the distance from the locking part 32 to the main rib 15*a* and the auxiliary rib 15*b*, and enlarging this distance leads to reduced reaction force. Accordingly, the locking element 30 is mounted on the suction grille 14 such that the long plate spring 31*a* engages the decorative panel 13 first when the suction grille 14 is attached to the decorative panel 13. Since the spring force of the long plate spring 31*a* is weak, the locking part 32 does not move toward the disengaging side or slant when the engagement takes place. Thus, placing the locking element 30 such that its long plate spring 31*a* resides closer to the rotary shaft 20 for opening and closing of the suction grille 14 allows for stable engagement and fixing of the locking element 30 to the decorative panel 13 and smooth attachment of the suction grille 14.

With reference to FIGS. 8 to 11, a description will now be made on the locking function when the suction grille 14 is opened and closed.

Figure 8:
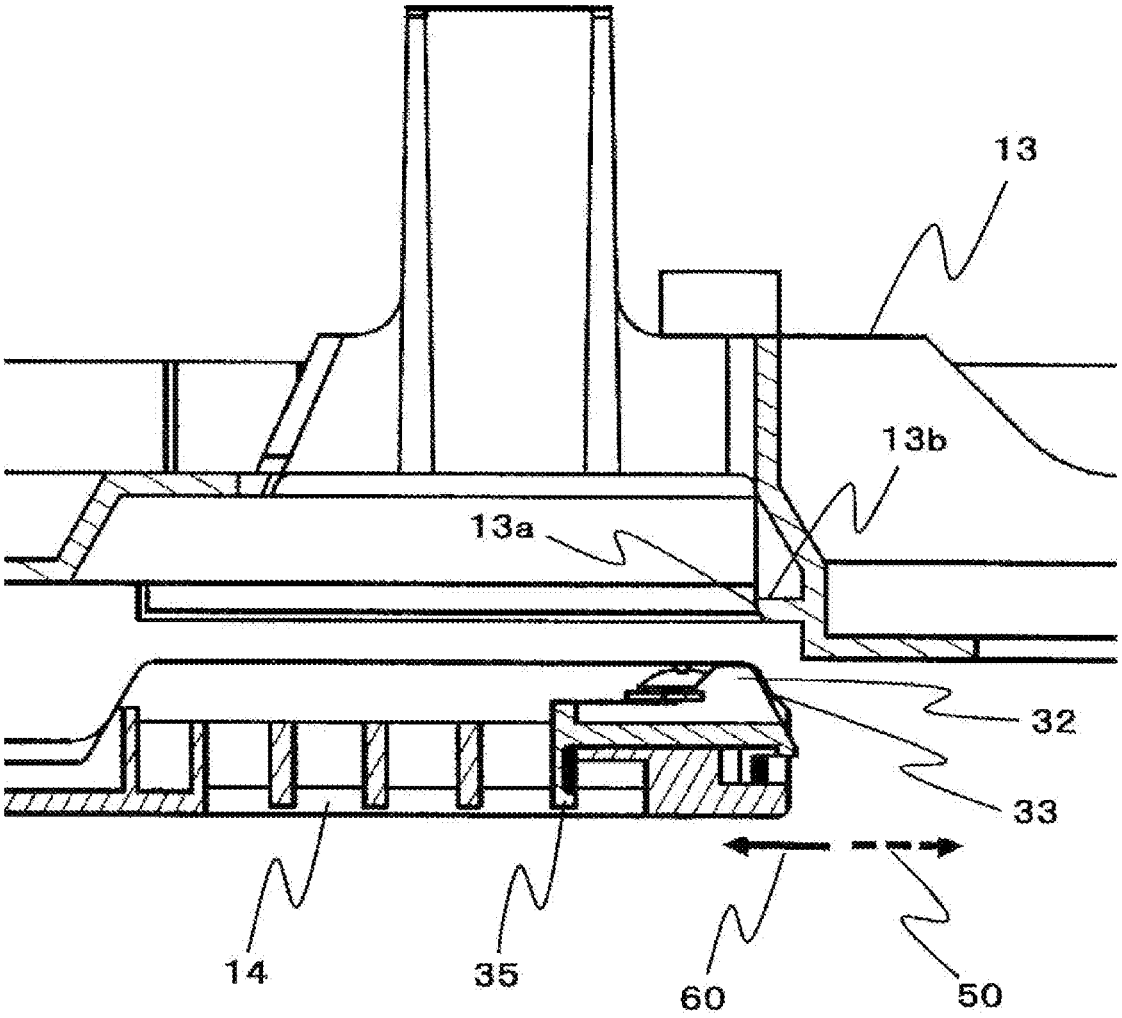
FIG. 8 is a sectional view showing a positional relationship between the locking element and a decorative panel when the suction grille of the ceiling concealed air-conditioning apparatus according to Embodiment 1 of the present invention is lifted close to the decorative panel.
Figure 9:
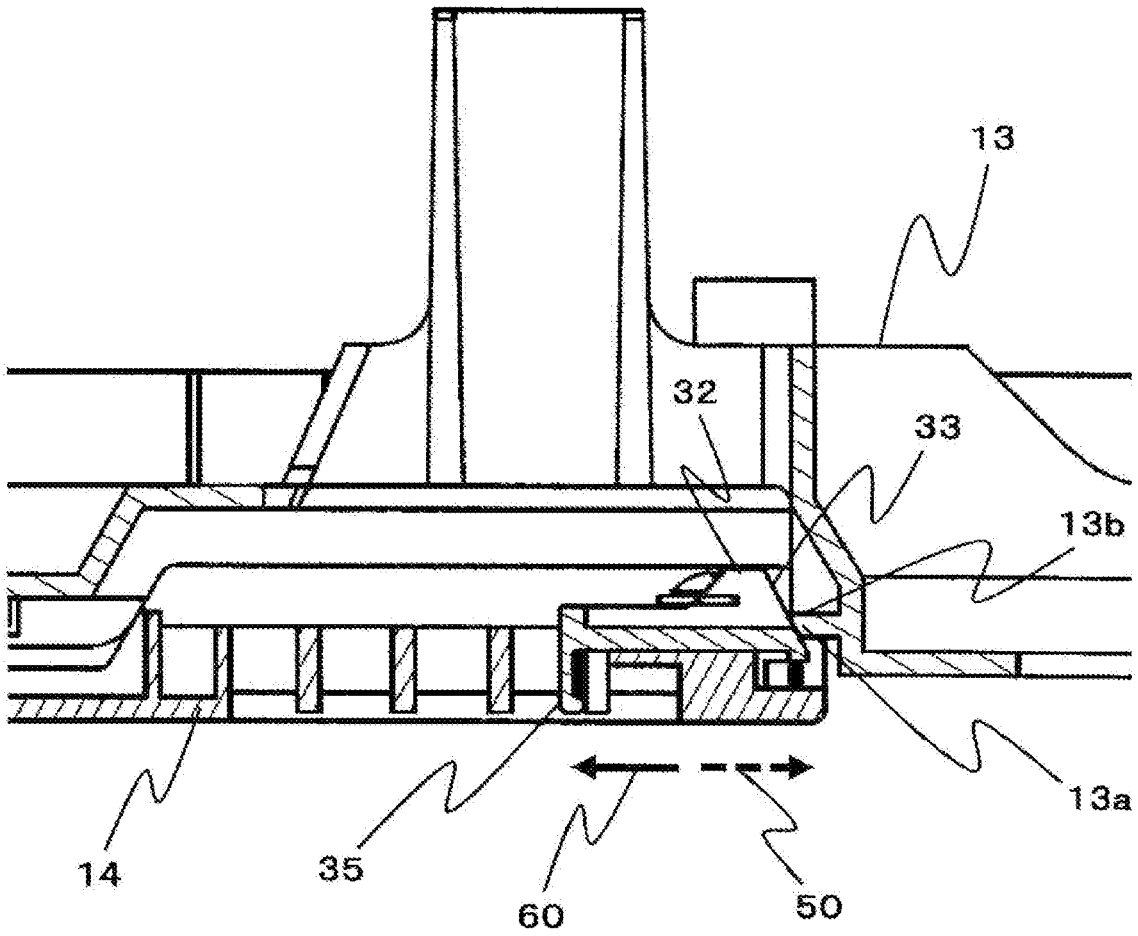
FIG. 9 is a sectional view showing a positional relationship between the locking element and the decorative panel when the suction grille of the ceiling concealed air-conditioning apparatus according to Embodiment 1 of the present invention is about to be closed into the decorative panel.
Figure 10:
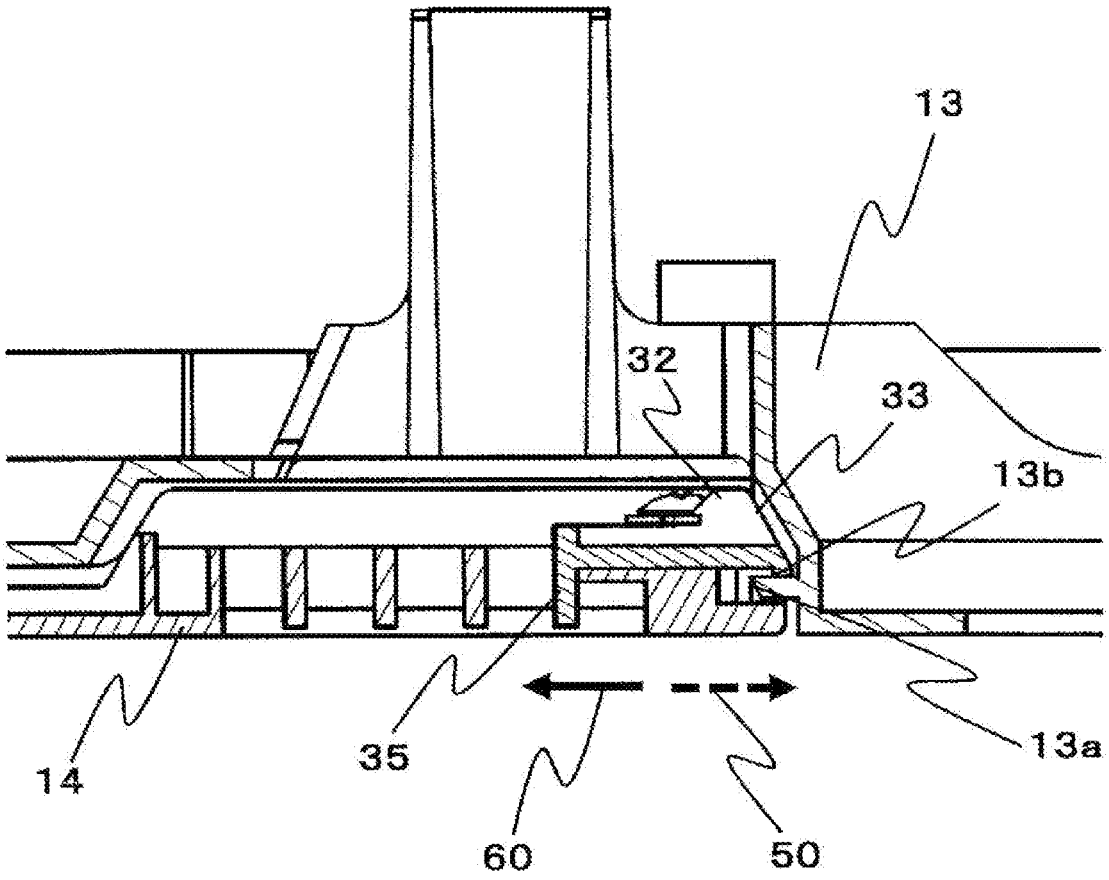
FIG. 10 is a sectional view showing a positional relationship between the locking element and the decorative panel when the suction grille of the ceiling concealed air-conditioning apparatus according to Embodiment 1 of the present invention has been closed into the decorative panel.
Figure 11:
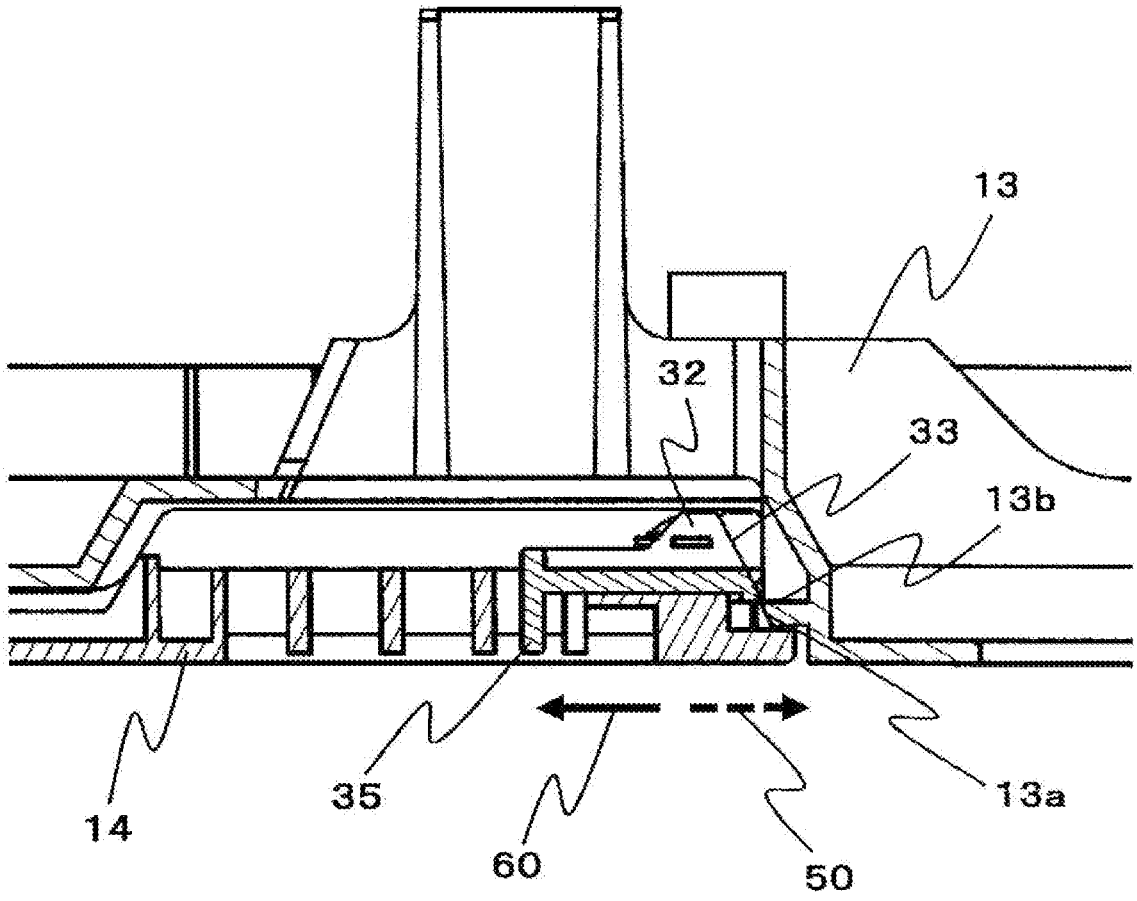
FIG. 11 is a sectional view showing a positional relationship between the retracted locking element and the decorative panel when the suction grille of the ceiling concealed air-conditioning apparatus according to Embodiment 1 of the present invention is opened from the decorative panel.

FIG. 8 is a sectional view showing a positional relationship between the locking element and the decorative panel when the suction grille of FIG. 3 is lifted close to the decorative panel. FIG. 9 is a sectional view showing a positional relationship between the locking element and the decorative panel when the suction grille of FIG. 8 is about to be closed into the decorative panel. FIG. 10 is a sectional view showing a positional relationship between the locking element and the decorative panel when the suction grille of FIG. 9 has been closed into the decorative panel. FIG. 11 is a sectional view showing a positional relationship between the locking element and the decorative panel when the locking element of FIG. 10 is retracted.

The decorative panel 13 includes, on its side wall facing the locking element 30, a protrusion piece protruding horizontally toward the opening port of the body 10. The protrusion piece has the length equal to the width of the locking element 30 and includes at its distal end a decorative panel-side guide part 13*a*. The guide part 13*a* has an inclined surface parallel to the inclined surface of the suction grille-side guide part 33 of the locking element 30. The protrusion piece is provided inside of the design surface of the decorative panel 13. Thus, no protrusion is required to be provided on the suction grille 14, which is operated to open and close by the user, and this ensures safety.

As shown in FIG. 8, when the suction grille 14 is lifted close to the decorative panel 13, the locking element 30 comes under the decorative panel-side guide part 13*a*. Further lifting the suction grille 14 causes the inclined surface of the suction grille-side guide part 33 of the locking element 30 to contact the inclined surface of the decorative panel-side guide part 13*a*, as shown in FIG. 9. Lifting the locking element 30 with these inclined surfaces contacting each other results in the locking element 30 being guided by the inclined surfaces. At this time, the slide parts of the locking element 30 retract in the direction (retracting direction 60) indicated by the solid arrow.

In this case, each of the long and short plate springs 31*a*, 31*b* on the respective sides of the locking element 30 bends in the retracting direction 60 around the main rib 15*a* and the auxiliary rib 15*b* as fulcrums against the elastic force. In this state, when the suction grille 14 is pushed into the decorative panel 13, the locking element 30 advances in the direction (advancing direction 50) indicated by the dashed arrow by the elastic force of the long and short plate springs 31*a*, 31*b*, as shown in FIG. 10, resulting in the suction grille-side locking part 32 of the locking element 30 being locked into a decorative panel-side fixed locking part 13*b*. By locking of the locking element 30, the suction panel 14 closes the opening port of the body 10.

On the other hand, when the suction panel 14 closing the opening port of the body 10 is opened, the operation part 35 of the locking element 30 is manually pulled in the direction indicated by the solid arrow, as shown in FIG. 11. This moves the locking part 32 of the locking element 30 away from the fixed locking part 13*b* of the decorative panel 13, releasing the lock. By release of the lock, the suction panel 14 opens the opening port of the body 10 by rotating around the rotary shaft 20.

In the present embodiment as described above, the long and short plate springs 31*a*, 31*b* extending from the respective sides of the locking element 30 have different spring lengths and are also held by the main rib 15*a* and the auxiliary rib 15*b* at different distances from the locking part 32. This can, by leveraging the property that the bending spring force against the elastic force varies depending on the length of the spring, absorb any engagement displacement of the locking element 30 on the suction grille 14 in the transverse direction, improving operability.

Also, using the main rib 15*a* and the auxiliary rib 15*b* formed on the suction panel 14 as fulcrums can disperse the load applied when the plate spring exerts its spring function. This can increase the durability of the plate spring molded from a resin material. Further, arranging the main rib 15*a* and the auxiliary rib 15*b* face-to-face allows for mounting the plate spring while correcting variations in its shape, and this can absorb the backlash of the plate spring.

Figure 12:
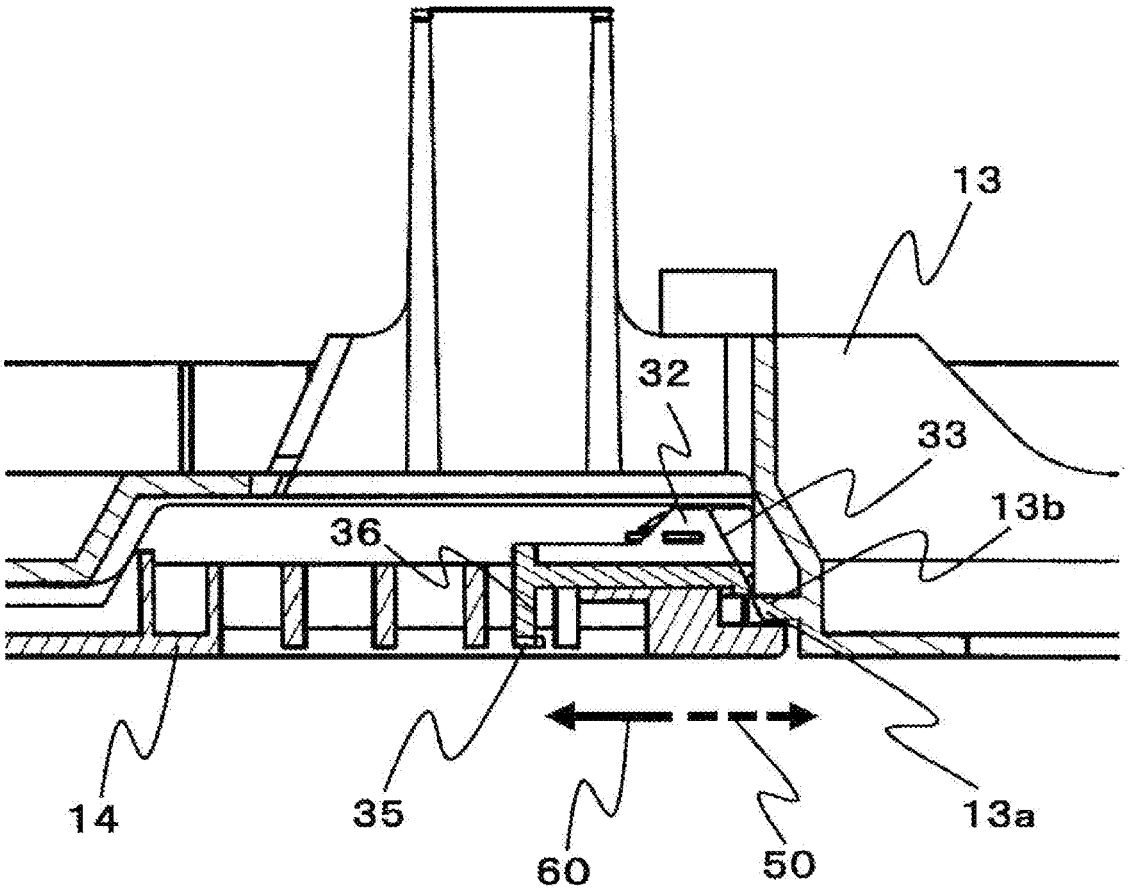
FIG. 12 is a sectional view of an operation part for operating the locking element of the suction grille of the ceiling concealed air-conditioning apparatus according to Embodiment 1 of the present invention.

Alternatively, a lower end of the operation part 35 may be protruded toward the locking part 32 to form an operation groove 36, as shown in FIG. 12. FIG. 12 is a sectional view showing a modification of the locking element in the present embodiment. The operation groove 36 can serve as a finger hook, and thus forming the operation groove 36 allows for easy hooking of fingers to move the operation part 35 in the retracting direction 60, which ensures operability.

REFERENCE SIGNS LIST

10 body 11 heat exchanger 12 fan 13 decorative panel 13*a* decorative panel-side guide part 13*b* decorative panel-side fixed locking part

14 suction grille 15*a* main rib 15*b* auxiliary rib 16 air inlet 17 air outlet 18 air filter 19 wind path 20 rotary shaft 21 edge on the rotary shaft

30 locking element 31*a* long plate spring 31*b* short plate spring 32 suction grille-side locking part 33 suction grille-side guide part 34*a* portion that engages first 34*b* portion that engages second 35 operation part 36 guide groove 40 screw 50 advancing direction 60 retracting direction 200 ceiling plate

The invention claimed is:

1. A ceiling concealed air-conditioning apparatus comprising:

a body containing a heat exchanger and a fan and including an opening port at a bottom;

a decorative panel disposed below the body, the decorative panel being configured to cover a periphery of the opening port of the body; and a suction grille including, on one edge thereof, a rotary shaft that can be attached to the decorative panel, the suction grille being configured to cover the opening port of the body so as to allow the opening port to be opened, wherein the suction grille includes:

a latch mounted on a rear side of the suction grille so that it can slide and configured to be locked with the decorative panel;

plate springs on respective sides of the latch perpendicular to a sliding direction of the latch, the plate springs extending vertically in opposite directions to each other; and spring supports provided to the suction grille and configured to support both end faces of the respective plate springs at different positions, the latch is configured such that the plate springs on respective sides of the latch can be locked with the decorative panel, the plate springs include a long plate spring and a short plate spring having different lengths, and the latch and the long and short plate springs are configured such that a first side of the latch closer to the long plate spring engages with the decorative panel before a second side closer to the short plate spring.

2. The ceiling concealed air-conditioning apparatus of claim 1, wherein a distance between the latch and one of the spring supports holding the long plate spring extending from the latch is longer than a distance between the latch and an other one of the spring supports holding the short plate spring.

3. The ceiling concealed air-conditioning apparatus of claim 1, wherein the latch mounted on the suction grille is placed on each of edges of the suction grille that extend at right angles from the edge of the suction grille attached to the decorative panel via the rotary shaft.

4. The ceiling concealed air-conditioning apparatus of claim 1, wherein, when the latch slides in a retracting direction away from the decorative panel, the plate springs energize the latch in a direction for engagement with the decorative panel by using as fulcrums the respective spring supports holding the respective plate springs at the different positions.

5. The ceiling concealed air-conditioning apparatus of claim 1, wherein the fan comprises a cross-flow fan, and the heat exchanger is V-shaped and placed between the fan and the suction grille, a longitudinal direction of the suction grille in a rectangular shape coincides with an axial direction of the cross-flow fan, and the latch is placed on each side of the suction grille in a transverse direction.

6. The ceiling concealed air-conditioning apparatus of claim 1, wherein the long and short plate springs are separate elements that are respectively attached to different sides of the latch.

7. The ceiling concealed air-conditioning apparatus of claim 1, wherein the long plate spring is formed on a first side of the latch perpendicular to the sliding direction of the latch, the short plate spring is formed on a second side of the latch different from the first side perpendicular to the sliding direction of the latch, and the long and short plate springs extend vertically in opposite directions to each other.

8. The ceiling concealed air-conditioning apparatus of claim 1, wherein the long plate spring is attached to the first side of the latch, and the short plate spring is attached to the second side of the latch.

9. The ceiling concealed air-conditioning apparatus of claim 1, wherein the long plate spring and the short plate spring are separate elements that are each attached to the latch.

* * * * *